US008070267B2

(12) United States Patent
Takeuchi et al.

(10) Patent No.: US 8,070,267 B2
(45) Date of Patent: Dec. 6, 2011

(54) INK JET RECORDING HEAD AND PRODUCTION PROCESS THEREOF

(75) Inventors: Souta Takeuchi, Yokohama (JP); Yoshiyuki Imanaka, Kawasaki (JP); Takuya Hatsui, Tokyo (JP); Takaaki Yamaguchi, Yokohama (JP); Takahiro Matsui, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 889 days.

(21) Appl. No.: 12/112,159

(22) Filed: Apr. 30, 2008

(65) Prior Publication Data

US 2008/0273053 A1 Nov. 6, 2008

(30) Foreign Application Priority Data

May 2, 2007 (JP) ..... 2007-121569

(51) Int. Cl.
*B41J 2/05* (2006.01)

(52) U.S. Cl. ..... 347/67; 347/22; 347/27

(58) Field of Classification Search ..... 347/22, 347/27, 67

See application file for complete search history.

(56) References Cited

U.S. PATENT DOCUMENTS

| | | | |
|---|---|---|---|
| 5,173,717 | A | 12/1992 | Kishida et al. |
| 5,357,268 | A | 10/1994 | Kishida et al. |
| 6,290,334 | B1 | 9/2001 | Ishinaga et al. |
| 6,474,789 | B1 | 11/2002 | Ishinaga et al. |
| 6,962,405 | B2 | 11/2005 | Imanaka et al. |
| 6,969,154 | B2 | 11/2005 | Takeuchi et al. |
| 7,255,426 | B2 | 8/2007 | Ibe et al. |
| 7,338,150 | B2 | 3/2008 | Ibe et al. |
| 2004/0012654 | A1 | 1/2004 | Takeuchi et al. |
| 2006/0125881 | A1 | 6/2006 | Kubo et al. |
| 2006/0232633 | A1 | 10/2006 | Kubo et al. |

FOREIGN PATENT DOCUMENTS

| | | | |
|---|---|---|---|
| JP | 3-247455 | A | 11/1991 |
| JP | 5-185594 | A | 7/1993 |
| JP | 8-108536 | A | 4/1996 |
| JP | 2004-50646 | A | 2/2004 |

*Primary Examiner* — Jerry Rahll

(74) *Attorney, Agent, or Firm* — Fitzpatrick, Cella, Harper & Scinto

(57) ABSTRACT

An ink jet recording element substrate includes a substrate; an ejection outlet array for ejecting ink; a heat generating element array comprising a plurality of heat generating elements for generating ejection energy for ejecting the ink from the ejection outlet array; a protecting film, comprising protecting portions, for protecting the heat generating element array; a common line, disposed along a side of the heat generating element array, for supplying electric power for driving the heat generating elements, and being divided into at least two portions by a line perpendicular to the heat generating element array; a testing electrode for testing a function of the protecting film; and an externally connecting electrode, disposed at an end of the substrate, for externally supplying electric power to the common line; wherein the ink jet recording element substrate further includes, in an area between the portions of the common line, a connecting line for electrically connecting the protecting portions of the protecting film disposed to sandwich the common line and a lead line for electrically connecting the protective film and the testing electrode.

9 Claims, 6 Drawing Sheets

INK JET RECORDING HEAD AND PRODUCTION PROCESS THEREOF

FIELD OF THE INVENTION AND RELATED ART

The present invention relates to an ink jet recording head substrate, an ink jet recording head including the ink jet recording head substrate, and a recording apparatus including the ink jet recording head.

In an ink jet recording head using heat generating elements, the heat generating elements are provided in an ink chamber as a part of an ink flow path and an electric pulse as a recording signal is supplied to the heat generating elements to generate heat. The ink jet recording head ejects minute ink droplets from minute ejection outlets by utilizing bubble pressure of liquid ink bubbled (boiled) due to heat energy by the heat generation, thus effecting recording with respect to a recording medium. Such a recording head generally includes ink ejection outlets for ejecting ink droplets and a supplying system containing a flow path for supplying ink to the ejection outlets.

In such a recording head, the heat generating elements generate heat, so that the inside of the ink chamber is subjected to high temperatures. Accordingly, it is desirable that ink such that it is not denatured at high temperatures is selected and the heat generating elements are covered with a protecting film in order to protect the heat generating elements from being damaged by heat. Further, when bubbles generated by heating collapse, there is a possibility of an occurrence of corrosion at a metal surface by the action of water hammer. For this reason, it is preferable that an anti-cavitation film for preventing the corrosion is provided.

Japanese Laid-Open Patent Application (JP-A) Hei 5-185594 and JP-A Hei 8-108536 disclose a substrate for a recording head of an ink jet-type including heat generating elements, transistors for effecting switching of the heat generating elements, and a driving circuit for driving the heat generating elements. In order to realize downsizing of a substrate, above each of transistor array portions and drive circuit array portions, power source wiring (line) for supplying electric power to the heat generating elements and ground wiring (line) are configured to be superposed on these array portions and formed on the same substrate through a semiconductor process technology.

As described in JP-A Hei 3-247455, an ink jet recording head generally has such a structure that a plurality of ink ejection outlets communicates with a (single) common ink chamber (common ink supply port). For this reason, mutual interference between respective ejection outlets can occur to impair ink ejection characteristics such as an ink ejection speed, an amount of ink ejection, and so on. Therefore, it is desirable that a time-sharing driving method in which a group of a predetermined number of successive ejection outlets is taken as a block unit in which simultaneous ejection from the ejection outlets is forbidden and drive is temporally delayed, is employed as a driving means.

In recent years, demand for further high-speed and high-image quality ink jet recording apparatus has grown increasingly, so that a substrate for an ink jet recording head is required to include a larger number of heat generating elements and to be driven at a higher frequency. In order to drive the larger number of heat generating elements without changing a conventional thin film wiring process, studies on such a driving method that electric source lines are divided into a plurality of blocks each as a unit for time-sharing drive and the drive of the heat generating elements is performed by electric divided source lines as each block unit capable of accepting wiring (interconnection) resistance, have been made. However, this method involves problems of realization of high driving frequency for increasing the number of time-sharing drive block and accuracy of a current wiring process for increasing the number of individual divided lines, as limiting factors. Therefore, a demand for realization of power source lines with a common line formed in a thick film of a plated material or the like by changing the conventional thin film wiring process has grown.

FIG. 6 illustrates a layout of an embodiment of a conventional recording head substrate.

A recording device substrate 2000 includes heat generating elements 2101, transistors 2101, and driving circuits 2203 for managing drive thereof on an Si substrate, and is provided with electrode pads 2112 for external connection at end portions of the substrate. At portions between central heat generating element arrays and the electrode pads for external connection, circuits including a decoder, a shift register, a level converter, and so on are disposed as an end portion circuit group 2204. On these members, a silicon-based insulating film (protecting film) is formed on the entire surface of the substrate by CVD method etc. This protecting film not only has a function of protecting the heat generating elements (heat generating element array portion) 2101 from being thermally damaged but also has a function of ensuring insulative property at the transistor portion and the driving circuit portion.

Further, at a portion above the heat generating element array portion 2101, there is a possibility of an occurrence of corrosion by the action of water hammer during collapse of bubbles generated by heating. For this reason, an anti-cavitation film 2401 is formed by sputtering or the like in order to prevent the occurrence of corrosion. Further, a common power source line 2105 is formed above the transistor array portion 2102 by gold plating and a common grounding line 2110 is formed above the driving circuit portion 2203 by gold plating.

In a semiconductor process, the formation of the power source line by plating is required to be performed after a step of forming an inorganic metal thin film and a silicon-based thin protecting film by sputtering or the like and protection of the plated line is generally performed by applying a thick film of a synthetic resin material or the like. Thus, the recording head substrate is prepared by forming the electric source line and the grounding line above the transistor array portion and the driving circuit array portion via the silicon-based insulating film and applying thereon a film of the synthetic resin material identical to that for an ejection outlet forming member in order to protect the plated line. At the same time, it is desirable that at the heat generating element array portion, the anti-cavitation film as the metal film is formed via the silicon-based insulating film and thereon, the ejection outlet forming member of the same material as the plated line protecting material is applied so as to form ejection outlets.

In this case, the anti-cavitation film and the plated line are sandwiched between the same silicon-based insulating film and the same synthetic resin material film although they are located at different positions on the substrate. Therefore, in order to dispose these films while ensuring electric insulation therebetween, these films are required to be disposed so as not to contact each other and thus cannot intersect each other.

As described in JP-A 2004-50646, it is possible to reduce a size of a substrate by mutually connecting adjacent anti-cavitation films, interposing therebetween ejection outlets, with a connecting line to minimize the number of testing (inspecting) electrodes common to these anti-cavitation films. However, as shown in FIG. 6, when the plated common power source line is disposed between these anti-cavitation films, it is impossible to connect these anti-cavitation films with the connecting line. For this reason, depending on the arrangement of the common line, it is necessary to provide testing electrodes on each ejection outlet unit basis, thus leading to a large-size substrate.

As a method of connecting the respective anti-cavitation films, it can also be considered that a common line between the anti-cavitation films is provided in a circumventing manner. However, this method is required to avoid short circuit with an electrode lead for performing electrical mounting on the substrate and to sufficiently increase a distance between an externally connecting electrode to which the common line is to be connected and the circumventing connecting line in order to ensure reliability of the mounting portion. As a result, this method also cannot avoid the large-size substrate.

SUMMARY OF THE INVENTION

A principal object of the present invention is to provide a recording head substrate which is provided with a testing (inspecting) electrode for an anti-cavitation film and is reduced in size.

Another object of the present invention is to provide an ink jet recording head using the recording head substrate and an ink jet recording apparatus using the ink jet recording head.

According to an aspect of the present invention is to provide an ink jet recording element substrate comprising:

a substrate;

an ejection outlet array for ejecting ink;

a heat generating element array comprising a plurality of heat generating elements for generating ejection energy for ejecting the ink from the ejection outlet array;

a protecting film, comprising protecting portions, for protecting the heat generating element array;

a common line, disposed along a side of the heat generating element array, for supplying electric power for driving the heat generating elements, wherein the common line is divided into at least two portions by a line perpendicular to the heat generating element array;

a testing electrode for testing a function of the protecting film; and an externally connecting electrode, disposed at an end of the substrate, for externally supplying electric power to the common line;

wherein the ink jet recording element substrate further comprises, in an area between the portions of the common line, a connecting line for electrically connecting the protecting portions of the protecting film disposed to sandwich the common line and a lead line for electrically connecting the protective film and the testing electrode.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

[Recording Head Substrate]

An embodiment of a recording head substrate according to the present invention will be described.

Figure 1:
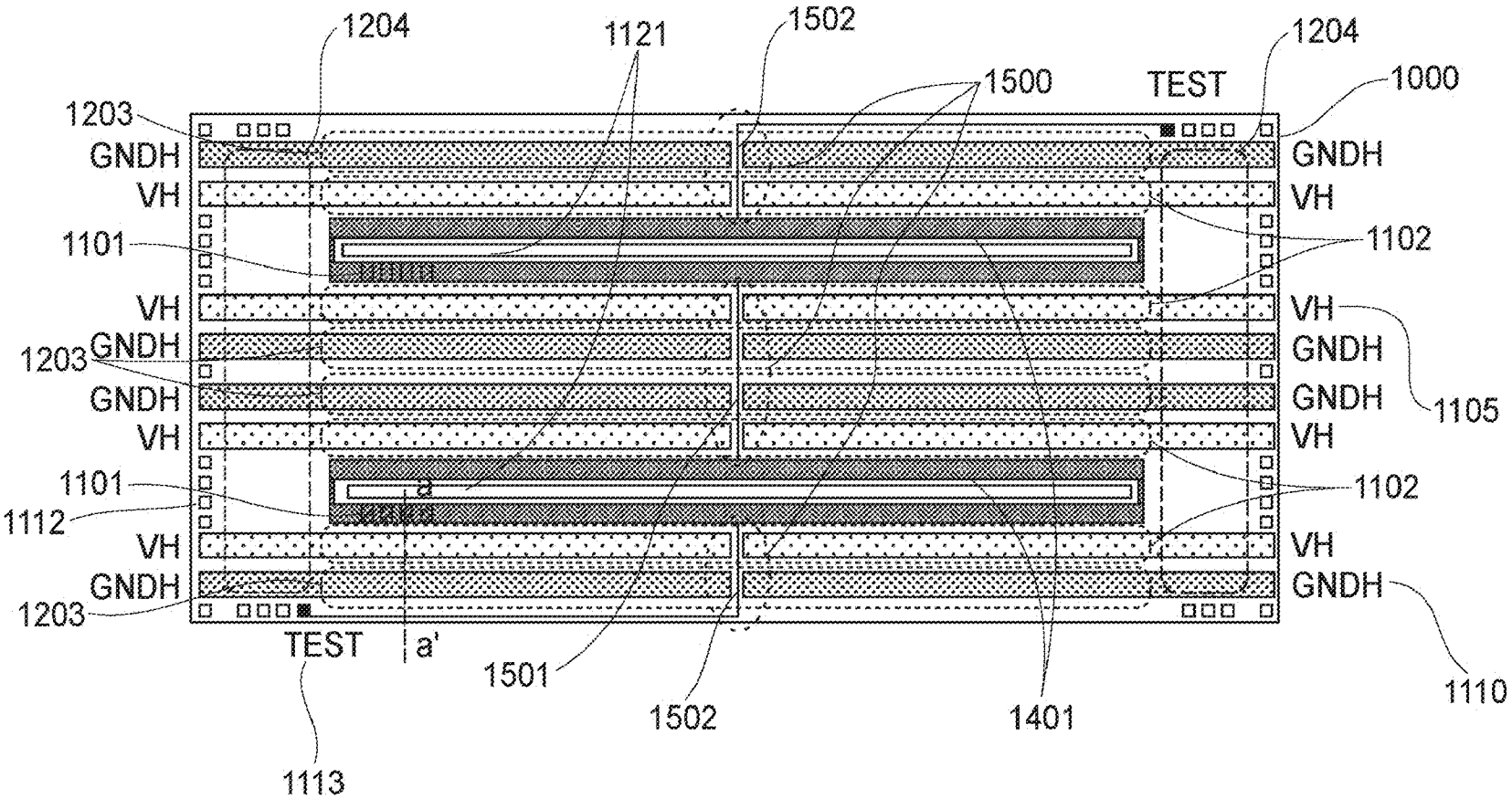
FIG. 1 is a schematic view showing a layout of a recording head substrate in an embodiment of the present invention.
Figure 2:
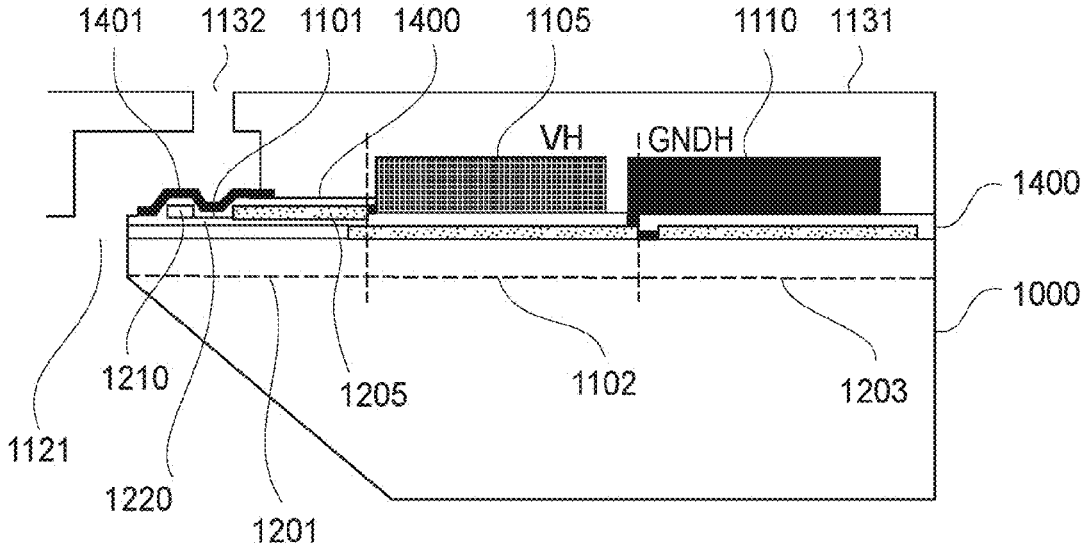
FIG. 2 is a schematic sectional view of the recording head substrate taken along a-a' line indicated in FIG. 1.

FIG. 1 is a schematic view showing a layout of the embodiment of the recording head substrate of the present invention. FIG. 2 is a schematic sectional view of the recording head substrate taken along a-a' line indicated in FIG. 1.

With respect to the recording head substrate, a multi-layer wiring technique is employed. (Wiring) lines for connecting respective constitutional elements are interposed between insulating films (protecting films) to provide a multi-layer structure. Further, the respective (upper and lower) lines are mutually connected by a through hole (an opening of the insulating film) at an arbitrary point on the substrate to form a circuit.

A recording device substrate 1000 includes heat generating elements 1101, transistors 1101, and driving circuits 1203 for managing drive thereof on an Si substrate, and is provided with electrode pads 1112 for external connection at end portions of the substrate. The heat generating elements 1101 provide ejection energy for ejecting ink to ink. At portions between central heat generating element arrays and the electrode pads for external connection, circuits including a decoder, a shift register, a level converter, and so on are disposed as an end portion circuit group 1204. On these members, a silicon-based insulating film (protecting film) is formed on the entire surface of the substrate by CVD method etc. This protecting film not only has a function of protecting the heat generating elements (heat generating element array portion) 1101 from being thermally damaged but also has a function of ensuring insulative property at the transistor portion 1102 and the driving circuit portion 1203.

A selection electrode line 1205 for being supplied with electric power from the power source line 1105 and a common electrode line 1210 for being electrically connected to a grounding line are disposed with a predetermined spacing on a heat generating resistance line to form the heat generating elements 1101.

Further, at a portion above the heat generating element array portion 1101, there is a possibility of an occurrence of corrosion by the action of water hammer during collapse of bubbles generated by heating. For this reason, an anti-cavitation film 1401 (elongated protecting film) is formed by sputtering or the like in order to prevent the occurrence of corrosion. Further, a common power source line 1105 is formed above the transistor array portion 1102 by gold plating and a common grounding line 1110 is formed above the driving circuit portion 1203 by gold plating. An elongated common grounding line 1110 supplies electric power for driving a heat generating element array consisting of a plurality of heat generating elements 1101. By employing this constitution, the common power source line 1105 and the grounding line 1110 do not extend an occupied area thereof on the substrate, thus contributing to downsizing of the substrate. Incidentally, hereinafter, the common power source line 1105 and the grounding line 1110 are sometimes inclusively referred to as a "common line". The elongated common grounding line may also be formed in a thickness of 1 μm or more.

A reference numeral 1500 shown in FIG. 1 represents a characterizing portion of the present invention where each of common lines is divided. In the embodiment shown in FIG. 1, two ink supply ports 1121 are formed and at a periphery of each ink supply port 1121, an anti-cavitation film 1401 is formed. A positional relationship among an ejection outlet array 1134 (FIG. 4) consisting of a plurality of ejection outlets 1131, the ink supply ports 1121, and the common lines is as follows. That is, the ink supply port 1121 is disposed along one of sides of the ejection outlet array 1134 and the common line is disposed along the other side of the ejection outlet array 1134. The dividing portion 1500 is formed so that each of the common line formed in an area interposed between adjacent two anti-cavitation films 1401 and the common lines formed on both sides of each anti-cavitation film 1401 is divided at a central portion thereof.

At the driving portion 1500, a connecting line 1501 and a lead line 1502 are formed with the same film as the anti-cavitation film 1401, thus being electrically connected with the anti-cavitation film 1401. That is, the film forming the common lines, the connecting line 1501, and the lead line 1502 is formed in the same plane as the anti-cavitation films 1401.

The connecting line 1501 is formed at the dividing portion 1500 driving the common line located in the area interposed between two anti-cavitation films 1401. By this connecting line 1501, the elongated anti-cavitation films 1401 disposed between two ink supply ports 1121 are electrically connected.

The lead line 1502 is formed at the dividing portion 1500 dividing the common lines formed on both sides of each anti-cavitation film 1401. That is, the lead line 1502 is led from each anti-cavitation film 1401 one by one and is connected to a protecting film testing electrode pad (TEST) formed at an outer peripheral portion of a chip.

As described above, in the case of this embodiment, the film forming the common lines, the connecting line 1501, and the lead line 1502 is formed in the same plane as the anti-cavitation film 1401. However, the common line is divided by the dividing portion 1500, so that the connecting line 1502 for mutually connecting the anti-cavitation films 1401 is not required to circumvent the common line.

Further, the anti-cavitation films are connected to each other, so that it is not necessary to provide the protecting film testing electrode pad (TEST) 1113 with respect to each of the anti-cavitation films 1401. Thus, it is possible to reduce the number of the protecting film testing electrode pads (TEST) 1113.

Figure 6:
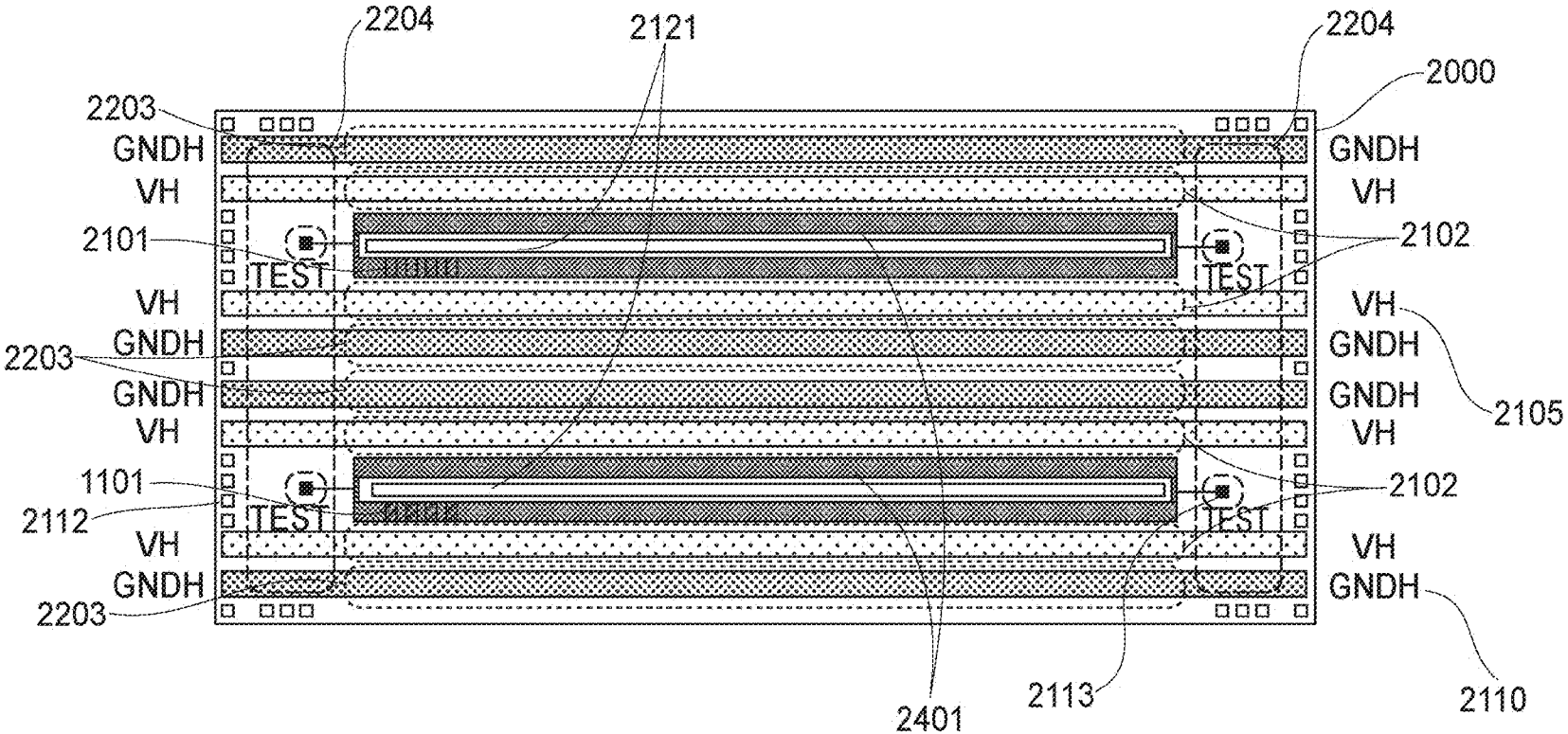
FIG. 6 is a schematic view showing a layout of a conventional recording head substrate.

For example, in the conventional embodiment of FIG. 6, four testing electrode pads are provided, whereas in the constitution shown in FIG. 1, two testing electrode pads which is half of that in the conventional embodiment is only required. In the conventional embodiment of FIG. 6, there is no portion for dividing the common line, so that anti-cavitation films provided on both peripheral portions of each ink supply port 1121 cannot be connected. For that reason, the number of the protecting film testing electrode pads (TEST) corresponds to that of the ink supply ports and is four in the case of the conventional embodiment of FIG. 6. This protecting film testing electrode pad (TEST) 1113 performs electrical testing with a prober, so that lines or circuit elements cannot be provided below and peripheral portions of the testing electrode pad 1113. For this reason, there are four holes in an area in which an end portion circuit group 1204 is disposed, with the result that the substrate is increased in size.

As a method of connecting the anti-cavitation films provided at both outer peripheral portions of each ink supply port 1121, other than the above-described method, the following method can also be employed. That is, such a method that a tantalum (Ta) connecting line is formed to connect the anti-cavitation films so as to circumvent a substrate end portion outside the common line, i.e., outside the externally connecting electrode pad 1112 for the power source line 1105 and the grounding line 1110 may be used. However, this method requires a sufficient distance between the externally connecting electrode pad 1112 to be connected with the common lines and the circumventing tantalum connecting line in order to ensure reliability of the mounting portion, with the result that the substrate is increased in size.

On the other hand, in the constitution shown in FIG. 1, the connecting line 1501 and the lead line 1502 are provided at the dividing portion 1500 dividing the common lines to reduce the number of protecting film testing electrode pads (TEST) 1113 to two, so that it is possible to reduce the size of the substrate.

Incidentally, the constitution shown in FIG. 1 is an example of a constitution in which two protecting film testing electrode pads 1113 are provided but the present invention is not limited thereto. In the constitution shown in FIG. 6, the testing electrode pad is disposed between two anti-cavitation films 1401 but in the case of this embodiment, the protecting film testing electrode pad 1113 can be disposed at an outer peripheral portion of the common line. For this reason, the protecting film testing electrode pad can be disposed orderly similarly as in the case of other testing electrodes. Such an arrangement is suitable for the downsizing of the substrate.

Next, a position at which the common line is divided will be described.

As shown in FIG. 1, in this embodiment, the common line is divided at a central portion with respect to the heat generating element array.

With respect to the division of the common line, description will be made by taking a case of 256 heat generating elements (ejection outlets) as an example.

A heat generating element array consisting of 256 heat generating elements 1101 is divided into two equal portions each consisting of 128 heat generating elements. At a position corresponding to this dividing position, the dividing portion 1500 is formed. That is, each of the common lines is divided at a position where the heat generating element array is divided into a plurality of heat generating element groups each consisting of the same number of heat generating elements. The substrate in this embodiment employs time-sharing drive. When a plurality of heat generating elements which are not driven temporally simultaneously and consecutively disposed is taken as a time-sharing block, the heat generating element array consisting of the 128 heat generating elements is constituted by 16 time-sharing blocks. Accordingly, the number of heat generating elements subjected to simultaneous ejection per one common line at the time of the whole ejection for driving all the heat generating elements at the same time is eight.

An important factor in designing the common line is a voltage drop of the common line in the case where the maximum number of heat generating elements subjected to simultaneous ejection is eight. A resistance value of the common line is determined so that the voltage drop can be not more than a predetermined value, so that a film thickness of the common line is determined. In this embodiment, the film thickness is about 1-10 μm. The common line may also be formed by gold plating.

In comparison with this embodiment, in the conventional embodiment, it can be considered that a state of the common line is equivalent to a state in which two divided common lines in this embodiment are connected to each other. Thus, the maximum simultaneous ejection number is 8×2=16. When voltage loss in this embodiment is taken as V=IR, a current passing through a supplying line in the conventional embodiment is 2I which is two times that in this embodiment, so that a combined resistance of the common line in the conventional embodiment is R/2 which is ½ of that in this embodiment. As a result, the voltage drop in the conventional embodiment is V=2I×(R/2)=IR. That is, the voltage drop of the common line divided at its central portion in this embodiment is identical to that in the conventional embodiment. A difference of this embodiment from the conventional embodiment is a voltage drop during single ejection for driving only one of the heat generating elements of the heat generating element array. During the single ejection, the voltage drop in this embodiment is two times that in the conventional embodiment. However, the film thickness of the common line is originally determined in view of the voltage drop with respect to the maximum number of heat generating elements during the simultaneous ejection, so that the difference during the single ejection does not cause a problem.

[Circuit Constitution of Recording Head Substrate]

Figure 3:
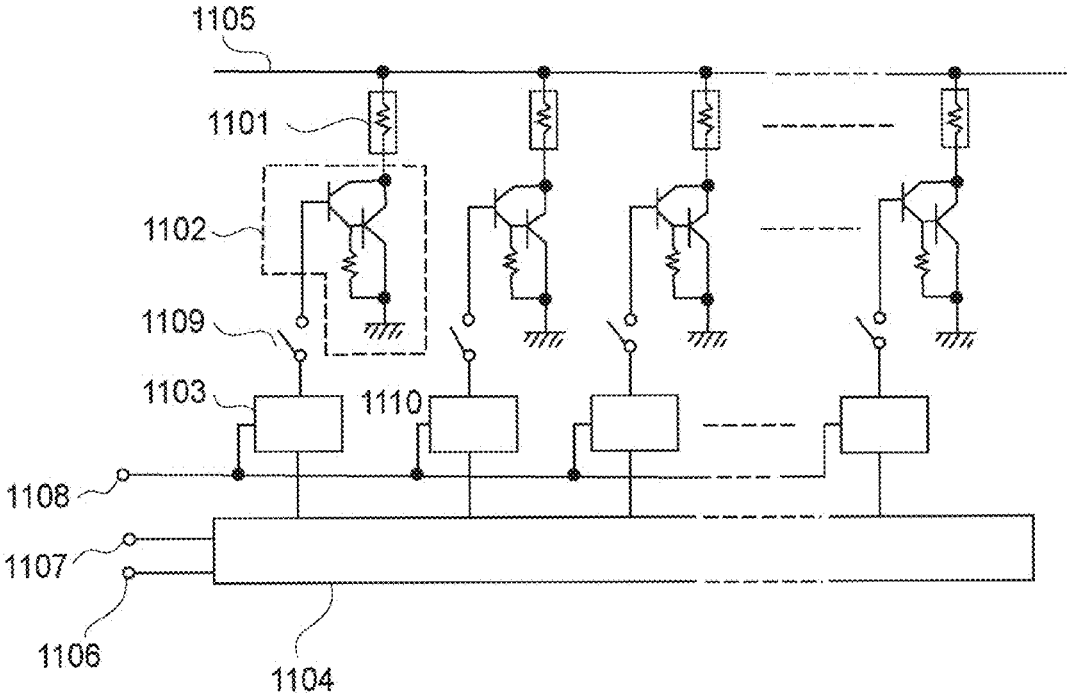
FIG. 3 is a schematic circuit diagram of the recording head substrate.

A recording head mounted in a recording apparatus of an ink jet-type has a circuit constitution as shown in FIG. 3. Heat generating elements (heaters) and its driving circuit of such a recording head are formed on the same substrate through a semiconductor process technology.

Referring to FIG. 3, the recording head includes heat generating elements (heaters) 1101 for generating heat energy, (power) transistor portions 1102 for supplying a desired current to the heaters 1101, a shift register 1104 for temporarily storing image data for determining whether or not ink is ejected from an ejection outlet of the recording head by supplying a current to each of the heaters 1101, a transfer clock input terminal (CLK) 1107 provided to the shift register, an image data input terminal (DATA) 1106 for serially inputting image data for turning the heaters 1101 on or off, and latch circuits 1103 for storing and retaining image data with respect to each heater for each heater. The recording head further includes a latch signal input terminal (LT) 1108 for inputting a timing signal for latch into the latch circuits 1103, a switch 1109 for determining timing for supplying the current to the heaters 1101, a power source line (VH) 1105 for applying a predetermined voltage to the heaters 1101 to supply a current to the heaters 1107, and a grounding line (GNDH) 1110 for performing grounding of the heaters 1101 through the transistors 1102.

The number of bits of the image data stored in the shift register 1104 is equal to the number of the power transistors 1102 and the number of the heaters 1101.

Into the transfer clock input terminal 1107, a transfer clock (CLK) corresponding to the number of bits of the image data to be stored in the shift register 1104 is inputted. When the data transfer to the shift register 1104 is performed in synchronism with timing of rising of the transfer clock (CLK), image data (DATA) for turning each heater on or off is inputted from the image data input terminal 1106. As described above, the number of bits of the image data stored in the shift register 1104 is equal to the number of the heaters 1101 and the number of the power transistors 1102. Therefore, pulses of the transfer clock (CLK) are inputted by the number of times corresponding to the number of the heaters 1101, thus transferring image data (DATA) to the shift register 1104. Thereafter, a latch signal (LT) is inputted into the latch signal input terminal 1108. By this operation, the image data corresponding to each heater is held in the latch circuit 1103. Thereafter, when the switch 1109 is turned on at an appropriate time, a current is caused to pass through the transistor 1102 and the heater 1101 via the power source line 1105 for a time corresponding to an ON-state time of the switch 1109. This current flows into the grounding line (GNDH) 1110 again. At this time, the heater 1101 generates heat necessary to eject ink and ink in an amount corresponding to the image data is ejected from the ejection outlet.

[Projection Process of Recording Head Substrate and Recording Head]

A production process of the recording head substrate and the recording head in this embodiment will be described.

Figure 4:
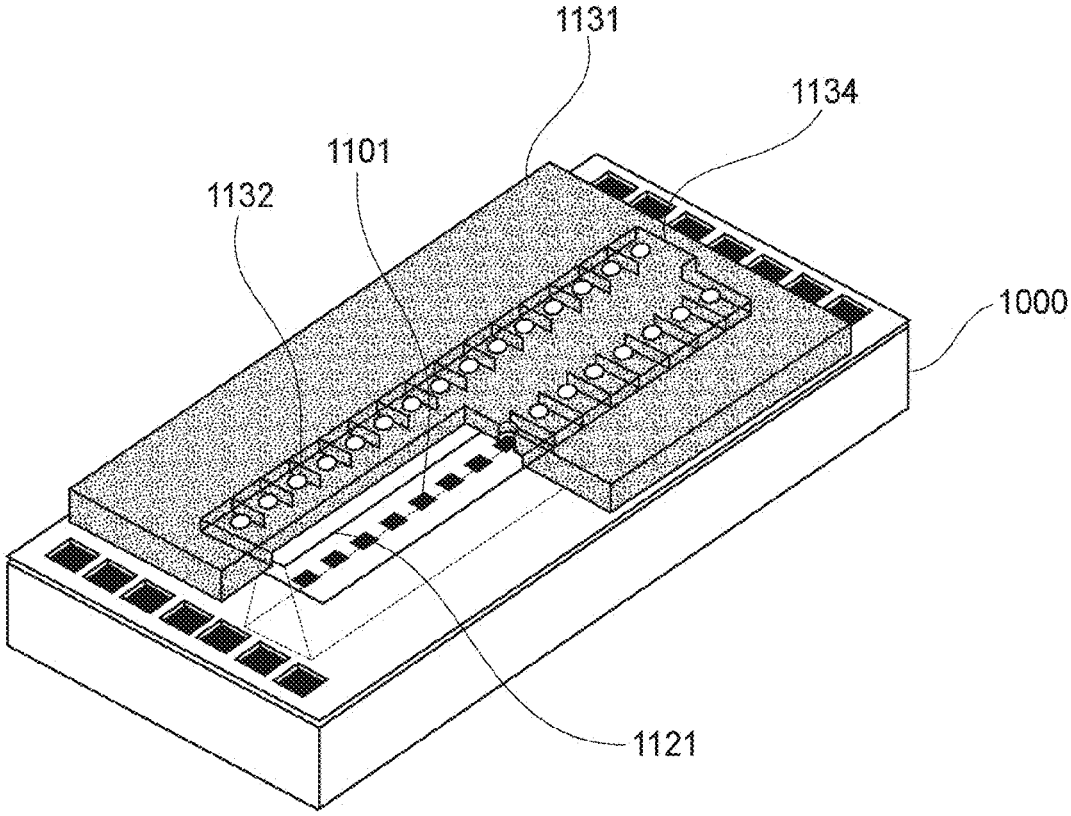
FIG. 4 is a perspective view showing an embodiment of a recording head.

FIG. 4 is a schematic perspective view showing an embodiment of an ink jet recording head using the recording head substrate in this embodiment.

Referring to FIG. 4, on a surface of an Si wafer substrate 1000 having a thickness of 0.5-1.0 mm, heat generating element 1101, transistor, and driving circuit elements are formed by using a semiconductor process. Thereon, a silicon-based insulating film (protecting film) is formed by CVD or the like and on a heat generating element array portion 1201, an anti-cavitation film is formed of tantalum by sputtering or the like. Further, on a transistor array portion 1102 and a driving element array portion 1203, common lines is formed by gold plating to constitute a power source line and a grounding line, respectively. The tantalum anti-cavitation film is led, so as to circumvent the common lines formed by gold plating, to a protecting film testing electrode pad portion. On the protecting film testing electrode pad portion, a gold-plated bump is formed and on other externally connecting electrode pads, a gold-plated bump is formed. Then, electrical short-circuit check is performed by applying electric power to the protecting film testing electrode pad, thus conducting electrical testing as to whether or not the silicon-based insulating film (protecting film) on the heat generating elements 1101 is formed with no defect.

A mold material which is a resist is formed at a portion constituting an individual flow passage portion for supplying ink to each ejection outlet. Onto the entire surface of the mold material, a synthetic resin material for an ejection outlet forming member 1131 is applied. This ejection outlet forming member 1131 is configured to form the ejection outlets and flow passages in the neighborhood of the heat generating elements and has a function as a protecting film for the gold-plated common lines at the transistor array portion and the driving circuit array portion. Thereafter, the mold material is removed by dissolution or the like to form flow passages and finally, an ejection outlet portion is completed by providing openings at portions for forming ejection outlets 1132.

An ink supply port 1121 for supplying the ink is formed by anisotropic etching utilizing crystal orientation of an Si substrate 1000. By the anisotropic etching, such an ink supply port 1121 as to have an elongated through-like with an inclined surface such that a width thereof is gradually decreased from a lower portion to an upper portion.

The thus-constituted recording head substrate is connected with a flow passage member for introducing the ink into the ink supply port 1121 for supplying the ink and is combined with an ink accommodating container, so that it is possible to constitute a recording head cartridge. Particularly, it is possible to effect color recording by constituting a recording head cartridge in such a manner that containers for accommodating a plurality of color inks and substrates for the respective color inks are used in combination.

[Recording Apparatus]

Figure 5:
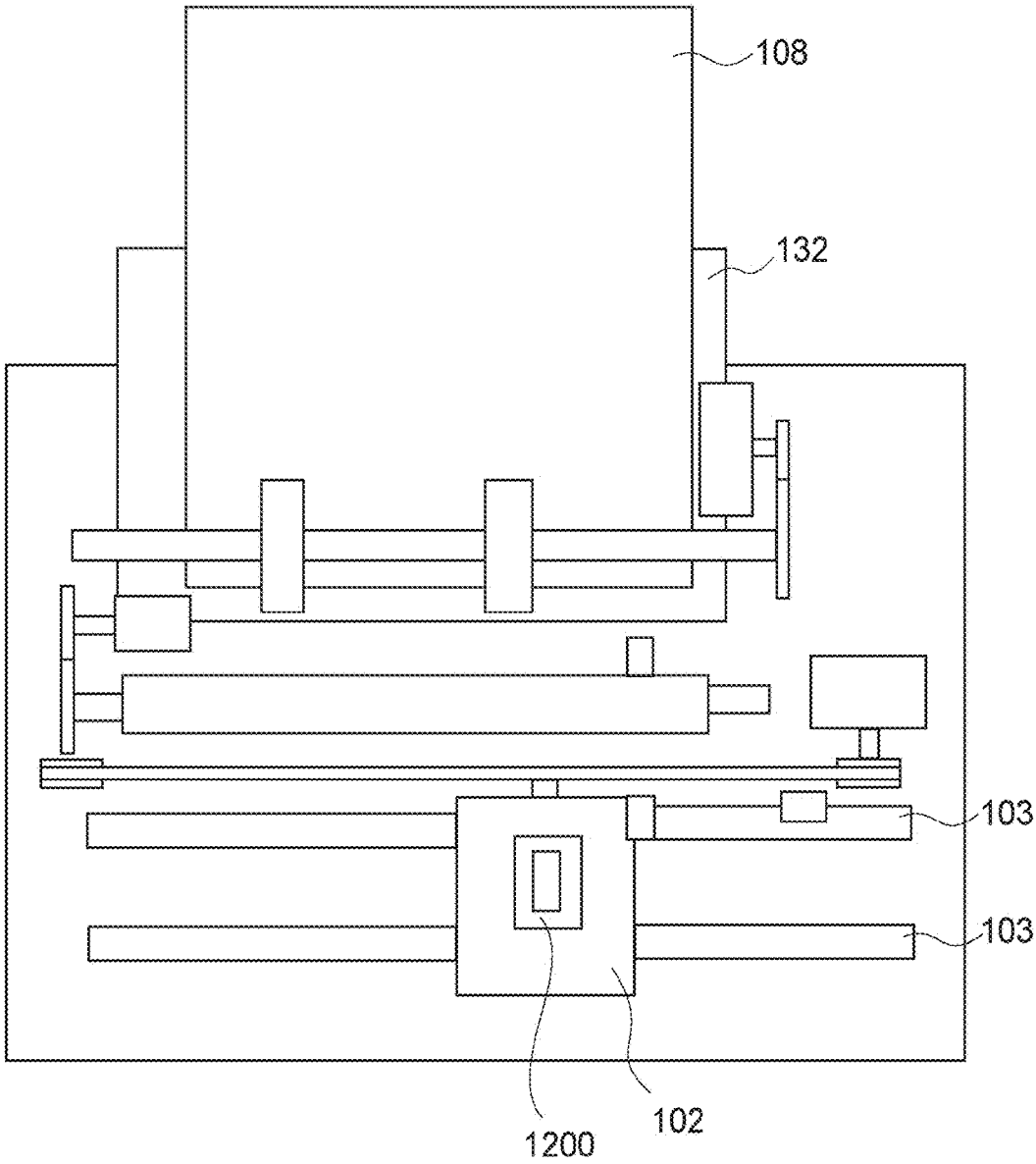
FIG. 5 is a schematic view for illustrating an embodiment of a recording apparatus.

Next, a recording apparatus capable of mounting the above-described recording head including the recording head substrate will be described. FIG. 5 is a schematic view for illustrating an embodiment of the recording apparatus according to the present invention.

In the recording apparatus shown in FIG. 5, a recording head cartridge 1200 is constituted by combining the recording head including the recording head substrate of the present invention with an ink accommodating container. The recording head cartridge 1200 is positioned and replaceably mounted on a carriage 102, and an electrically connecting portion for transmitting a driving signal and so on to each ejection portion via an external signal input terminal provided on the recording head cartridge 1200 is provided to the carriage 102.

The carriage 102 is guided and supported reciprocably along a guide shaft 103 provided to an apparatus main assembly extended in a main scanning direction. That is, the carriage 102 reciprocally moves in a direction substantially perpendicular to a conveyance direction of a recording medium 108 such as a recording sheet, a plastic thin plate, or the like.

The recording medium 108 is separated and fed from an automatic sheet feeder (ASF) 132 one by one and conveyed (sub-scanned) through a position (print portion) opposite to an ejection outlet-formed surface of the recording head cartridge.

The recording medium 108 is supported at its back surface by a platen (not shown) at the print portion. In this case, the recording head cartridge 1200 mounted on the carriage 102 is held so as to oppose the recording medium 108 in such a manner that the ejection outlet-formed surface thereof is downwardly projected from the carriage 102.

The recording head cartridge 1200 is mounted on the carriage 102 so that a direction of arrangement of ejection outlets at each ejection portion is perpendicular to the above-described scanning direction of the cartridge 102, and ejects ink from an array of these ejection outlets to effect recording.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 121569/2007 filed May 2, 2007, which is hereby incorporated by reference.

What is claimed is:

1. An ink jet recording element substrate comprising:

a substrate;

an ejection outlet array for ejecting ink;

a heat generating element array comprising a plurality of heat generating elements for generating ejection energy for ejecting the ink from said ejection outlet array;

a protecting film, comprising protecting portions, for protecting said heat generating element array;

a common line, disposed along a side of said heat generating element array, for supplying electric power for driving the heat generating elements, wherein said common line is divided into at least two portions by a line perpendicular to said heat generating element array;

a testing electrode for testing a function of said protecting film; and an externally connecting electrode, disposed at an end of said substrate, for externally supplying electric power to said common line;

wherein said ink jet recording element substrate further comprises, in an area between the portions of said common line, a connecting line for electrically connecting the protecting portions of said protecting film disposed to sandwich said common line and a lead line for electrically connecting said protective film and said testing electrode.

2. A substrate according to claim 1, wherein said common line, said connecting line, and said lead line are formed in a film in the same plane as the protecting film.

3. A substrate according to claim 1, wherein said common line is divided at a position at which the heat generating element array is divided equally into a plurality of groups of heat generating elements, wherein the groups are equal in number of heat generating elements.

4. A substrate according to claim 1, wherein in the case where the heat generating element array comprises a plurality of time-sharing blocks, each comprising a plurality of continuously disposed heat generating elements, which are not driven at the same time and said common line is provided in a plurality of common lines, each common line is divided at a position at which the heat generating element array comprising the plurality of time-sharing blocks is equally divided.

5. A substrate according to claim 1, wherein said common line is formed on a silicon-based insulating film formed at a surface of said substrate and is protected with a member for forming said ejection outlet array.

6. A substrate according to claim 1, wherein said common line is a gold-plated line.

7. A substrate according to claim 1, wherein said protecting film is an anti-cavitation film formed of tantalum.

8. An ink jet recording head comprising an ink jet recording head substrate according to claim 1.

9. An ink jet recording apparatus comprising:

conveying means for conveying a recording medium; and an ink jet recording head according to claim 8 for effecting recording by ejecting ink onto the recording medium.

* * * * *